US010077734B2

(12) United States Patent
Chia et al.

(10) Patent No.: US 10,077,734 B2
(45) Date of Patent: Sep. 18, 2018

(54) HIGH-PRESSURE INJECTION DEVICE FOR AN INTERNAL COMBUSTION ENGINE

(71) Applicant: CONTINENTAL AUTOMOTIVE GMBH, Hannover (DE)

(72) Inventors: Tet Kong Brian Chia, Regensburg (DE); Thomas Kraft, Obertraubling (DE); Andreas Bodensteiner, Lappersdorf (DE); Walter Sassler, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/714,618

(22) Filed: Sep. 25, 2017

(65) Prior Publication Data

US 2018/0010544 A1 Jan. 11, 2018

Related U.S. Application Data

(63) Continuation of application No. PCT/EP2016/052370, filed on Feb. 4, 2016.

(30) Foreign Application Priority Data

Mar. 27, 2015 (DE) ..... 10 2015 205 586

(51) Int. Cl.
*F02M 63/02* (2006.01)
*F02D 41/38* (2006.01)
*F02M 37/00* (2006.01)

(52) U.S. Cl.
CPC ..... *F02D 41/3863* (2013.01); *F02M 37/0052* (2013.01); *F02M 63/025* (2013.01);
(Continued)

(58) Field of Classification Search
CPC ..... F02M 63/023; F02M 63/0235; F02M 63/025; F02D 2250/31
(Continued)

(56) References Cited

U.S. PATENT DOCUMENTS 9,551,631 B2 * 1/2017 Carey ..... F02D 41/2441
2011/0232610 A1 * 9/2011 Okamoto ..... F02D 41/3863 123/495
2015/0020777 A1 * 1/2015 Carey ..... F02D 41/22 123/445

FOREIGN PATENT DOCUMENTS

DE 102006035312 A1 8/2007
DE 102009031529 B3 11/2010
(Continued)

OTHER PUBLICATIONS

International Search Report and Written Opinion dated Apr. 21, 2016 from corresponding International Patent Application No. PCT/EP2016/052370.
(Continued)

*Primary Examiner* — Erick Solis

(57) ABSTRACT

A high-pressure injection device for an internal combustion engine to which engine segment times are assigned, having a high-pressure pump, a rail connected to the high-pressure pump via a high-pressure fuel line, at least one injector, a digital pressure reduction valve connected to the rail, a fuel return line connected to the pressure reduction valve, and a control unit. The control unit is configured to switch the pressure reduction valve into the transmissive state only in predetermined engine segment times, and to maintain said transmissive state of the pressure reduction valve for a time period which is greater than the duration of one engine segment time.

10 Claims, 4 Drawing Sheets

(52) U.S. Cl.
CPC .... *F02M 63/0235* (2013.01); *F02M 63/0265* (2013.01); *F02D 2200/101* (2013.01); *F02D 2250/31* (2013.01)

(58) Field of Classification Search
USPC ..... 123/458, 512
See application file for complete search history.

(56) References Cited

FOREIGN PATENT DOCUMENTS

| | | | |
|---|---|---|---|
| DE | 102013213506 | A1 | 4/2014 |
| DE | 102014106512 | A1 | 11/2014 |
| EP | 1900930 | A1 | 3/2008 |
| EP | 2085596 | A2 | 8/2009 |

OTHER PUBLICATIONS

German Office Action dated Aug. 2, 2015 for corresponding German Patent Application No. 10 2015 205 586.8.

* cited by examiner

HIGH-PRESSURE INJECTION DEVICE FOR AN INTERNAL COMBUSTION ENGINE

CROSS-REFERENCE TO RELATED APPLICATIONS

This application claims the benefit of PCT Application PCT/EP2016/052370, filed Feb. 4, 2016, which claims priority to German Patent Application 10 2015 205 586.8, filed Mar. 27, 2015. The disclosures of the above applications are incorporated herein by reference.

FIELD OF THE INVENTION

The invention concerns a high-pressure injection device for an internal combustion engine, in particular a common rail injection device.

BACKGROUND OF THE INVENTION

Common rail injection devices are fuel injection devices for internal combustion engines, in which a high-pressure pump compresses the fuel to a high pressure and delivers this fuel, compressed to a high pressure, via a high-pressure line into a high-pressure fuel accumulator which is generally known as a rail. From this rail, injectors are supplied with fuel and inject the fuel, compressed to a high pressure, into the combustion chambers of the respective internal combustion engine. The injectors here act as valves activated electromagnetically or piezo-electrically, via which the fuel is introduced into the combustion chamber.

In order to ensure as dynamic and precise a pressure supply as possible, a common rail injection device has a fuel return system. This comprises a pressure reduction valve connected to the rail, via which surplus fuel can be returned to the fuel tank of the respective vehicle.

With such a high-pressure injection device, the fuel pressure is always regulated to a desired nominal pressure by a control unit. This regulation is achieved by activating a metering unit arranged on the low-pressure side so as to meet demand.

When the internal combustion engine is a four-stroke engine, the cylinders of the engine are offset to each other such that after two crankshaft revolutions, i.e. after 720°, the first cylinder can begin the working cycle again. This offset gives a mean ignition interval. The time period in-between is known as the segment time of the internal combustion engine. The rotation speed and hence also the segment time are determined from the crankshaft signal. The ignition times and the injection itself are recalculated in step with the segment time. The rotation speed gives the mean crankshaft rotation speed in the segment time and is proportional to the inverse of the segment time.

In known high-pressure injection devices, the pressure reduction occurring via the pressure reduction valve takes place in segment synchrony with a segment of the internal combustion engine, within a single engine segment time. Such a segment-synchronous pressure reduction via the pressure reduction valve has the disadvantage that the pressure reduction times are coupled to the engine segment times, and hence limited. For example, for an internal combustion engine with four cylinders, at a rotation speed of 1000 rpm, the pressure reduction time would be limited to less than 30 ms. In this time period, the pressure reduction valve must be opened and closed again in good time before the start of the next engine segment time, in order to avoid an energy transfer from pulse to pulse and hence a loss of control performance. Consequently, with known high-pressure injection devices, within an engine segment time there is always a safety interval from the next pulse, which further limits the time within which the pressure reduction occurring via the pressure reduction valve can take place.

SUMMARY OF THE INVENTION

The object of the invention is to indicate a high-pressure injection device in which the pressure reduction is improved.

This object is achieved by a high-pressure injection device with the features given in claim 1. Advantageous embodiments and refinements of the invention are given in the dependent claims.

According to the present invention, a high-pressure injection device is created for an internal combustion engine to which engine segment times are assigned, comprising a fuel tank, a high-pressure pump, a rail connected to the high-pressure pump via a high-pressure fuel line, at least one injector, a digital pressure reduction valve connected to the rail, a fuel return line connected to the pressure reduction valve, and a control unit, wherein the control unit is configured to switch the pressure reduction valve selectively into the transmissive state only in predetermined engine segment times, and to maintain said transmissive state for a time period which is greater than one engine segment time.

Preferably, the control unit is configured to predetermine the engine segment times in which the pressure reduction valve is switched into the transmissive stage, as a function of the operating state of the internal combustion engine.

Advantageously, the control unit is configured to determine the operating state of the internal combustion engine taking into account a sensor signal provided by a high-pressure sensor. This has the advantage that if the pressure value has increased substantially, a rapid pressure reduction can take place in that the pressure reduction valve is opened for example only in every second engine segment time, but has an opening duration which is greater than one engine segment time. This is the case because there is no need to maintain a safety interval from the next pulse within the duration of each engine segment time, but only within the duration of two engine segment times. In this way, the opening duration of the pressure reduction valve is extended in comparison with known high-pressure injection devices, in which the pressure reduction valve is opened in synchrony with the engine segment during a single engine segment time, so that the pressure reduction can be accelerated.

Additionally or alternatively, the control unit is configured to determine the operating state of the internal combustion engine taking into account a sensor signal provided by a rotation speed sensor, and then change the engine segment times during which the pressure reduction valve is opened and held open, if an integral multiple of a predetermined measurement rotation speed is present. For example, the control unit is configured such that when twice the measurement rotation speed value is present, it switches the pressure reduction valve into the transmissive state on every second engine segment time, and holds it open for a time period which is greater than the duration of one engine segment time. Furthermore, the control unit may be configured such that, when three times the value of the measurement rotation speed is present, it switches the pressure reduction valve into transmissive state only on every third engine segment time, and holds it open for a time period which is greater than twice the duration of one engine segment time. Such a switching reduction has the advantage that, despite the presence of a changed rotation speed, the control performance of the high-pressure injection device is retained.

A further advantage of the invention is achieved if the fuel return line returns fuel to a fuel filter arranged between the fuel tank and the high-pressure pump, in order to implement a filter preheat function, in particular in the cold season. Thus with the invention it is possible to compress a larger quantity of fuel, heat it and return it to the filter supply. This advantageously takes place even at low rotation speeds. In this case, the control unit is configured such that at low temperatures which are signaled to it by a temperature sensor, and at low rotation speeds which are signaled to it by the rotation speed sensor, it activates the above-mentioned switching reduction of the digital pressure reduction valve such that the number of closing and opening processes of the pressure reduction valve is reduced, and a larger quantity of fuel can be returned per time unit via the fuel return line to the fuel filter in order to preheat this.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantageous properties of the invention arise from the exemplary explanation below which is given with reference to the figures. The drawing shows.

DETAILED DESCRIPTION OF THE PREFERRED EMBODIMENTS

The following description of the preferred embodiment(s) is merely exemplary in nature and is in no way intended to limit the invention, its application, or uses.

The present invention provides a high-pressure injection device for an internal combustion engine to which engine segment times are assigned. This high-pressure injection device has a high-pressure pump, a rail connected to the high-pressure pump via a high-pressure fuel line, at least one injector, a pressure reduction valve connected to the rail, a fuel return line connected to the pressure reduction valve, and a control unit which is configured to switch the pressure reduction valve into the transmissive state only in predetermined engine segment times, and hold it in the transmissive state for a time period which is greater than one engine segment time.

Figure 1:
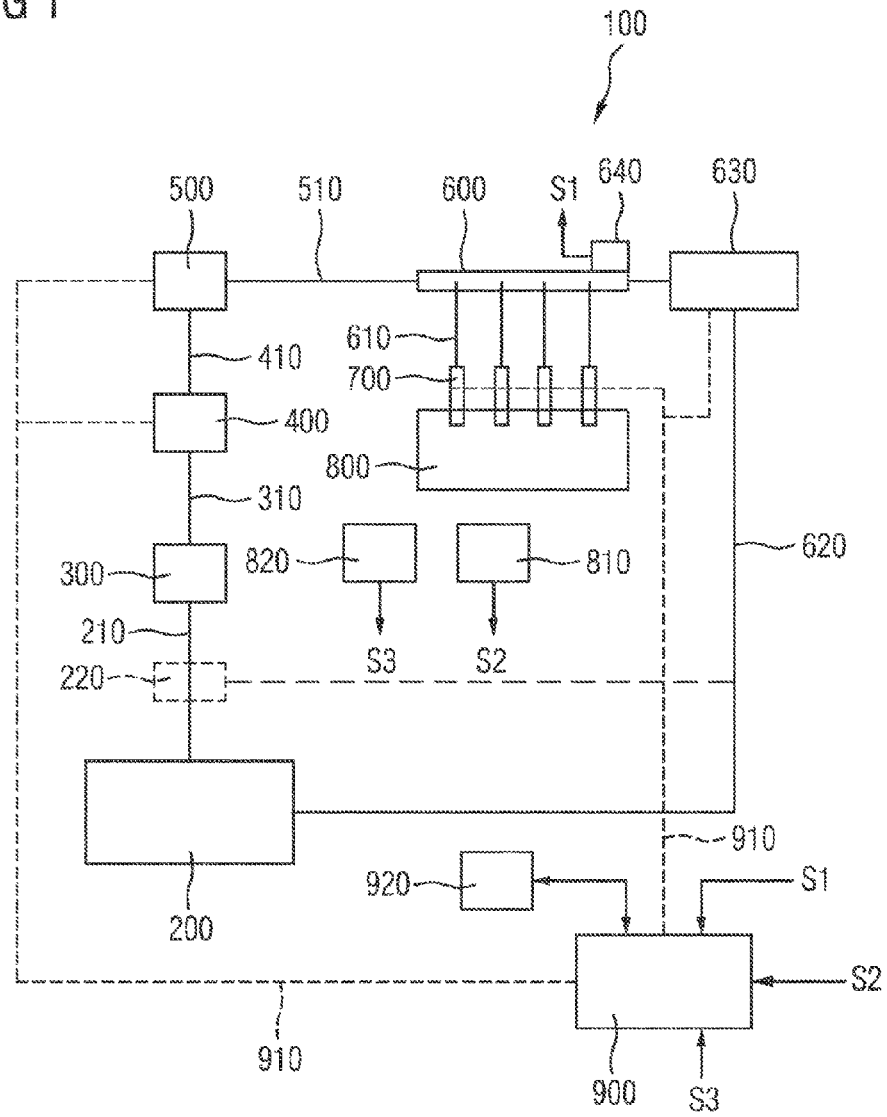
FIG. 1 is a block diagram to explain the structure of a high-pressure injection device.

FIG. 1 shows a block diagram to explain the structure of a high-pressure injection device 100. This has a fuel tank 200 from which fuel is extracted by a fuel pump 300 via a fuel line 210. A fuel filter, drawn in dotted lines, may be arranged in the fuel line 210. The fuel extracted from the fuel tank 200 by the fuel pump 300 is conducted via a fuel line 310 to an inlet valve 400. This inlet valve 400 regulates the inflow of fuel via a fuel line 410 to a high-pressure pump 500. The inlet valve 400 may be an integral part of the high-pressure pump 500. The fuel, compressed to a high pressure in the high-pressure pump 500, is transferred via a high-pressure fuel line 510 to a rail 600. From there, it passes via high-pressure lines 610 to injectors 700, via which the fuel, compressed to a high pressure, is injected into the combustion chambers of an internal combustion engine 800. The rail 600 is connected to a digital pressure reduction valve 630, which may also be an integral part of the rail. The digital pressure reduction valve 630 is connected via a fuel return line 620 to the fuel tank 200, in order to return surplus fuel from the rail 600 to the fuel tank 200 via the pressure reduction valve 630. Alternatively, the fuel returned via the fuel return line 620 may also be returned to the fuel filter 210, as indicated in FIG. 1 by the dotted lines. A pressure sensor 640 is provided to detect the fuel pressure present in the rail 600.

Furthermore, the high-pressure injection device 100 shown in FIG. 1 comprises a control unit 900, which is configured to control the injection processes of the high-pressure injection device 100. The control unit 900 is connected via control lines 910 to the inlet valve 400, the high-pressure pump 500, the injectors 700 and the pressure reduction valve 630. The control unit 900 controls the injection processes of the high-pressure injection device as a function of their momentary operating state, which it determines using sensor signals. These sensor signals include for example a sensor signal s1 emitted by a pressure sensor 640, a sensor signal s2 emitted by a rotation speed sensor 810, and/or a sensor signal s3 emitted by a temperature sensor 820.

According to the present invention, the control unit 900 is configured such that it switches the pressure reduction valve 630 into the transmissive state not during all engine segment times, but only in predetermined engine segment times, and maintains the open state of the pressure reduction valve for a time period which is greater than one engine segment time. For example, the control unit switches the pressure reduction valve into the transmissive state only on every second engine segment time, but holds this in the transmissive state for a time period which is greater than one engine segment time. Only at the end of the engine segment time following the respective second engine segment time is a safety interval required, in order to avoid an energy transfer from pulse to pulse and hence a loss of control dynamics. By providing an extended period for the transmissive state of the pressure reduction valve, it is achieved that per time unit a larger quantity of fuel can be output to the pressure return line 620 than in the known high-pressure injection devices. Furthermore, by the provision of an extended period for the transmissive state of the pressure reduction valve, a greater flexibility of fuel return is achieved.

Figure 2:
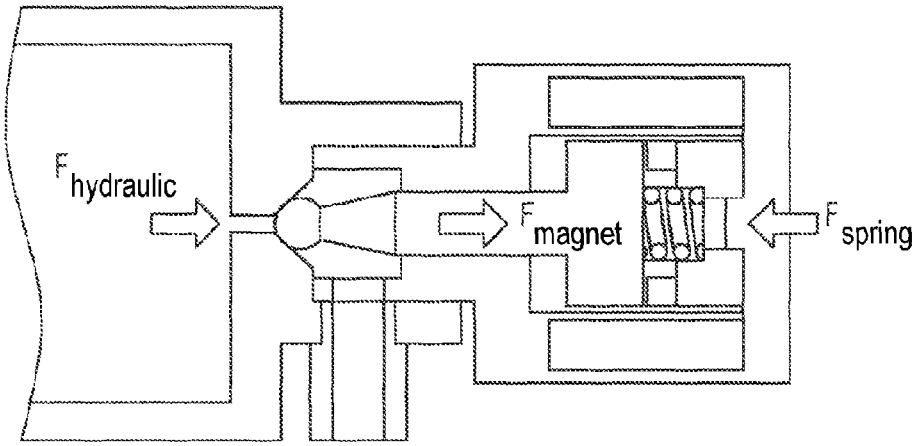
FIG. 2 is a sketch to illustrate an exemplary embodiment of a digital pressure reduction valve, FIG. 3 are time diagrams to explain the pressure reduction occurring via the pressure reduction valve over the duration of an engine segment time, FIG. 4 are time diagrams to explain the pressure reduction in the presence of a known high-pressure injection device.

FIG. 2 shows a sketch to illustrate a digital pressure reduction valve as may be used in the invention. This pressure reduction valve has a spring which, when not powered, holds the pressure reduction valve in the closed state with its spring force $F_{spring}$. This spring counters the fuel pressure prevailing in the rail, which exerts the force $F_{hydraulic}$, and holds the pressure reduction valve in the closed state. If the pressure reduction valve is to be opened, then in reaction to a control signal output by the control unit, a magnet arranged in the pressure reduction valve is activated such that it exerts a force $F_{magnet}$ which cooperates with the force $F_{hydraulic}$ in order to bring the pressure reduction valve into the opened, i.e. transmissive state against the spring force.

Figure 3:
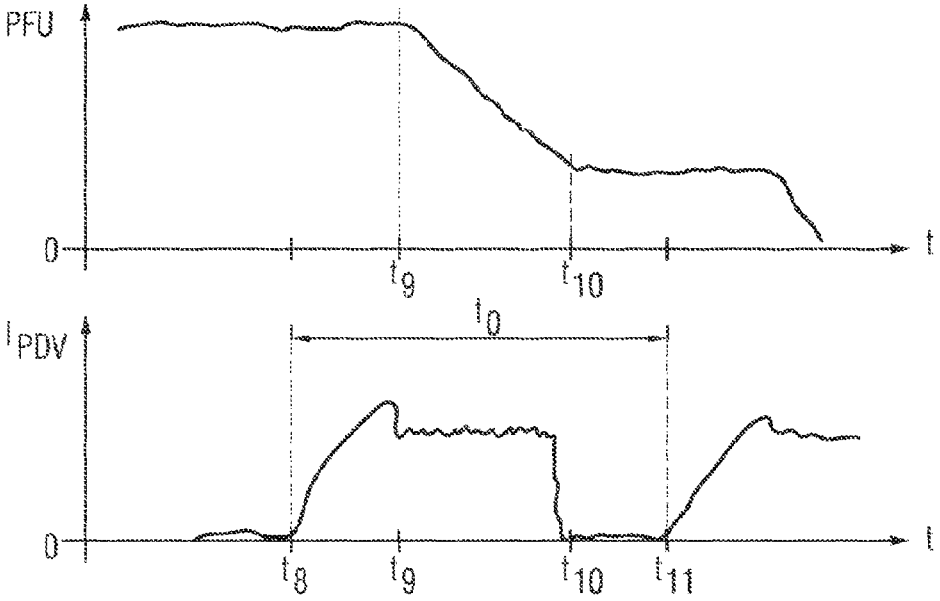

FIG. 3 shows time diagrams to explain the pressure reduction occurring via the pressure reduction valve over the duration of an engine segment time, as takes place in known high-pressure injection devices. The upper time diagram shows the development of the pressure PFU prevailing in the rail over the time t, and the lower diagram shows the development of the activation pulse $I_{PDV}$ output by the control unit over the time t.

FIG. 3 shows the duration to of an engine segment lasting from $t_8$ to $t_{11}$. Within this engine segment time, the control unit emits a pulse which has a steeply rising curve in the time interval from $t_8$ to $t_9$, a constant curve in the time interval between $t_9$ and $t_{10}$, and a steeply falling curve at time $t_{10}$. The time interval lying between $t_{10}$ and $t_{11}$ is the above-mentioned safety interval from the next pulse. As evident from the upper time diagram in FIG. 3, the pressure reduction in the rail takes place in the time interval between $t_9$ and $t_{10}$ in which the pressure reduction valve is opened.

Figure 4:
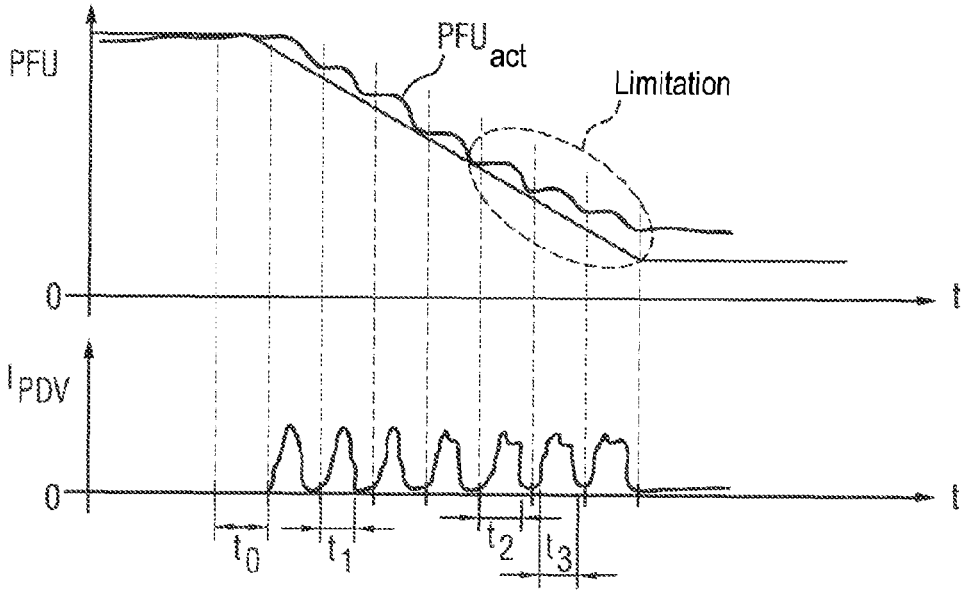

FIG. 4 shows time diagrams to explain the pressure reduction in the presence of a known high-pressure injection device. In this known high-pressure injection device, the pressure is reduced in synchrony with the engine segment, i.e. a pressure reduction period is restricted to the duration of one engine segment, wherein furthermore a safety interval from the succeeding activation pulse must be maintained before the end of the engine segment time period, and wherein the opening and closing of the pressure reduction valve takes place within a single engine segment time.

The upper time diagram of FIG. 4 shows the development of the pressure PFU prevailing in the rail over the time t, and the lower diagram of FIG. 4 shows the development of the activation pulses $I_{PVD}$ output by the control unit in successive engine segment times over the time t. The lower time diagram shows the engine segment time $t_0$ and some of the limited pulse times $t_1$, $t_2$ and $t_3$. It is clear that the duration of the activation pulses output by the engine control unit is in each case restricted to one engine segment time and, because of the above-mentioned safety interval, is even shorter than the duration of one engine segment time. It can be seen from the upper time diagram in FIG. 4 that the pressure reduction in the rail takes place in steps, wherein a step is limited to the duration of one engine segment time. This limitation is emphasized by the dotted outline of part of the curve of the pressure $PFU_{act}$.

Figure 5:
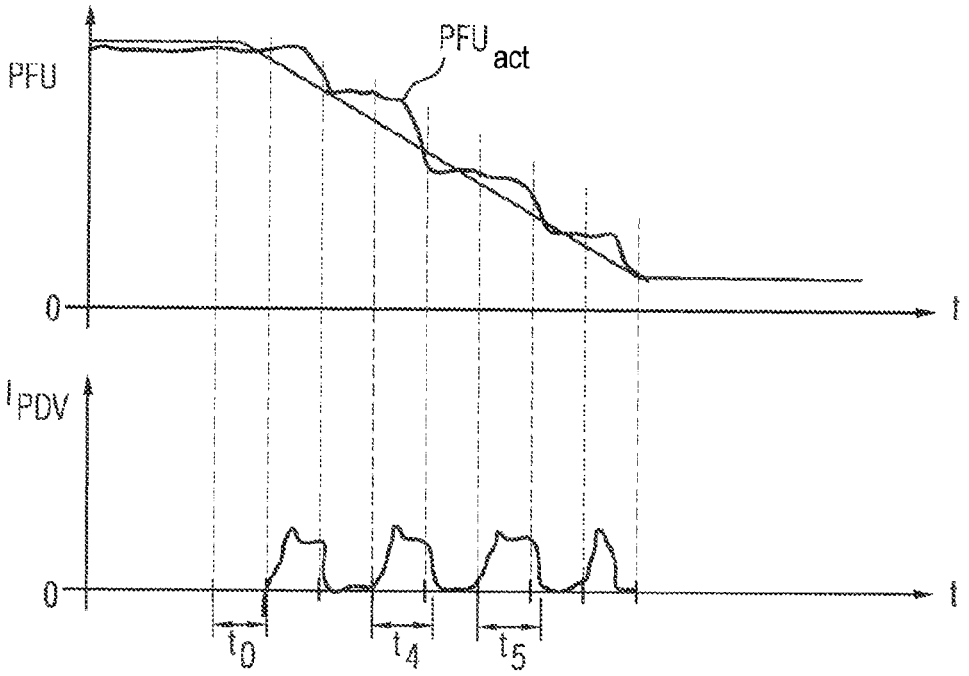
FIG. 5 are time diagrams to explain the pressure reduction of a high-pressure injection device according to an exemplary embodiment of the invention, and FIG. 6 are time diagrams to illustrate a filter preheat function in a known high-pressure injection device and in a high-pressure injection device according to the invention.

FIG. 5, in contrast, shows time diagrams to illustrate the pressure reduction in a high-pressure injection device according to the exemplary embodiment of the invention. In this high-pressure injection device, a pressure reduction period is not limited to the duration of one engine segment time, but is extended to the duration of two successive engine segment times. The pulse generated by the engine control unit to open and hold open the pressure reduction valve has a duration which is greater than one complete engine segment time. In the lower time diagram in FIG. 5, the engine segment time is again designated $t_0$. Furthermore, the lower time diagram in FIG. 5 shows some of the pulse times, marked $t_4$ and $t_5$. It is clear that the duration of these pulses is in each case greater than one engine segment time. In this exemplary embodiment, only one safety interval is provided during two successive engine segment times. This lies in the end region of the total time period covering two engine segment times. Therefore, the durations of two successive engine segment time periods are available for performance of an opening and closing process of the pressure reduction valve.

The upper time diagram of FIG. 5 shows the development of the pressure PFU prevailing in the rail over the time t. It is clear from this time diagram that, here again, the pressure reduction takes place in steps, wherein however a step is extended to the duration of two engine segment times. This, as has already been explained, allows a faster pressure reduction in the rail and furthermore creates flexibility in the pressure reduction.

In an advantageous embodiment of the invention, the control unit is configured such that it analyzes the rotation speed signal provided by the rotation speed sensor, and takes this into account in determining the engine segment times in which the pressure reduction valve is switched into the transmissive state.

This may take place for example as follows:

Assuming that the opening times of the pressure reduction valve have been measured at a measurement rotation speed of for example 1000 rpm, and this measurement rotation speed has been stored in a memory 920 as a reference value, the switching frequency of the pressure reduction valve is reduced such that it changes on integral multiples of this measurement rotation speed. For example, on the presence of twice the rotation speed compared with the measurement rotation speed, the control unit generates the activation signals for the pressure reduction valve so that this is switched into the transmissive state only on every second engine segment, but is held open for a time period which is greater than the duration of one engine segment time period.

Furthermore, on the presence of three times the rotation speed compared with the measurement rotation speed, the control unit generates the activation signals for the pressure reduction valve so that this is switched into the transmissive state only on every third engine segment, but held in the opened state for a time period which is greater than the duration of two engine segment time periods.

Furthermore, on the presence of four times the rotation speed compared with the measurement rotation speed, the control unit generates the activation signals for the pressure reduction valve such that this is switched into the transmissive state only on every fourth engine segment, but held in the open state for a time period which is greater than the duration of three engine segment time periods.

The advantage of this procedure is that even when different rotation speeds are present, the control performance of the high-pressure injection device is retained.

To implement a filter preheat function using a high-pressure injection device, fuel compressed in the high-pressure pump and, heated on this compression, is transferred to the rail and then, through the pressure reduction valve 630 and via the fuel return line 620, is used directly to heat the fuel filter 220 as indicated by the dotted line drawn to the fuel filter in FIG. 1.

In known high-pressure injection devices, for a fuel filter preheat function, the high-pressure pump is operated pre-controlled for a maximum quantity which can be dissipated through the pressure reduction valve, and the pressure regulation is achieved by the pressure reduction valve. Because the pressure build-up and reduction is limited to a single segment time in known high-pressure injection devices, in general, for example, on the presence of a low rotation speed or on the presence of a high rotation speed and a low pressure, the maximum delivery power of the pump cannot be used. The delivery power of the pump must consequently be limited for example to 50%.

On implementation of a fuel filter preheat function using a high-pressure injection device according to the invention, in contrast, the delivery power of the pump can be increased to 100%. This advantage is achieved in that, due to the switching of the pressure reduction valve into the transmissive state only in predetermined engine segment times, and due to the extended opening time of the pressure reduction valve, a higher pressure reduction can take place per time unit than with known high-pressure injection devices. This is explained in more detail below with reference to FIG. 6, which shows time diagrams to illustrate a filter preheat function with a known high-pressure injection device and a high-pressure injection device according to the invention.

Figure 6:
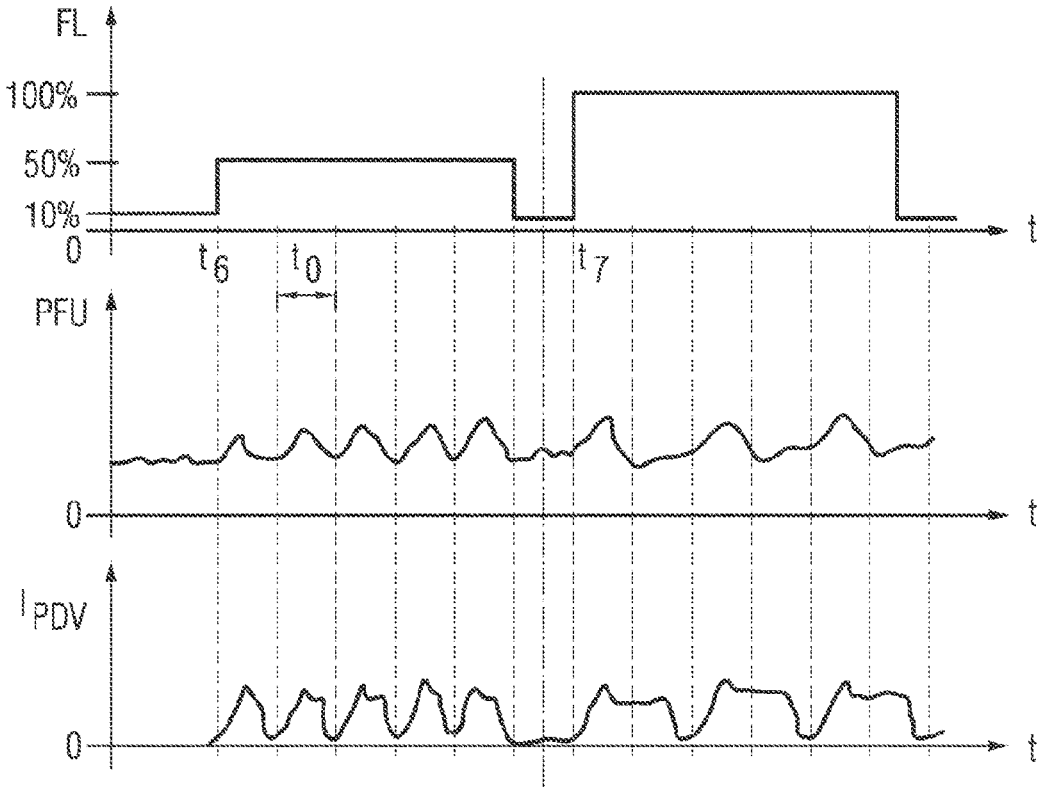

On the left of the vertical dotted line in FIG. 6, time diagrams are shown which explain the filter preheat function on use of a conventional high-pressure injection device, and on the right of the vertical dotted line in FIG. 6, time diagrams are shown which explain the filter preheat function of a high-pressure injection device according to the invention.

To the left and right of the dotted line, the lower time diagram shows the activation pulses emitted by the control unit over time. It is evident that, with the known high-pressure injection devices, the duration of the activation pulse is in each case limited to one engine segment time $t_0$, and that in the end region of each engine segment time, a safety interval from the next respective pulse is observed. Furthermore, it is clear that with a high-pressure injection device according to the invention, in the exemplary embodiment shown, in each case two engine segment times are available for the duration of the activation pulse, and a safety interval from the next activation pulse need be contained only in the end region of every second engine segment time.

The middle time diagram, on the left and right of the dotted line, shows the pressure prevailing in the rail over time. It is clear that with the known high-pressure injection devices, the pressure is built up and reduced respectively in the rail within a single engine segment time, whereas with the high-pressure injection device according to the invention, two engine segment times are available for the buildup and reduction in pressure respectively.

From the upper time diagrams in FIG. 6, it is clear that with the known high-pressure injection devices, the delivery power FL of the high-pressure pump is limited to 50%, whereas the delivery power of the pump in a high-pressure injection device according to the invention is 100%. In the upper time diagrams, the duration of one engine segment time is designated $t_0$, the time of activation of filter preheating with the known high-pressure injection device is designated $t_6$, and the time of activation of filter preheating with a high-pressure injection device according to the invention is designated $t_7$.

In the exemplary embodiments of the invention described above, in comparison with the known high-pressure injection devices, the number of opening and closing processes of the pressure reduction valve is reduced, and the time saved thereby is used to improve the pressure reduction occurring through the pressure reduction valve. In particular, it is achieved that the fuel quantity per time unit which can be returned via the fuel return line is increased. This has the advantage that excess pressure in the rail can be reduced more quickly than with known high-pressure injection devices. Furthermore, a device according to the invention may also be used to improve the function of preheating a fuel filter.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A high-pressure injection device for an internal combustion engine to which engine segment times are assigned, comprising:

a high-pressure pump;

a rail connected to the high-pressure pump via a high-pressure fuel line, at least one injector in fluid communication with the rail;

a digital pressure reduction valve connected to the rail;

a fuel return line connected to the pressure reduction valve; and a control unit;

wherein the control unit is configured to switch the pressure reduction valve into a transmissive state only in predetermined engine segment times, and to maintain the transmissive state of the pressure reduction valve for a time period which is greater than the duration of one engine segment time.

2. The high-pressure injection device of claim 1, wherein the control unit is configured to switch the pressure reduction valve into the transmissive state depending on the operating state of the internal combustion engine only in the predetermined engine segment times.

3. The high-pressure injection device of claim 2, further comprising:

a rotation speed sensor; and a sensor signal provided by the rotation speed sensor;

wherein the control unit is configured to determine the operating state of the internal combustion engine taking into account the sensor signal provided by the rotation speed sensor.

4. The high-pressure injection device of claim 3, further comprising:

a memory in which a measurement rotation speed is stored;

wherein the control unit is configured to change the predetermined segment times for the pressure reduction valve on integral multiples of the measurement rotation speed.

5. The high-pressure injection device of claim 4, wherein the control unit is configured to switch the pressure reduction valve into transmissive state only on every second engine segment time, and hold the pressure reduction valve open for a time period which is greater than the duration of one engine segment time if the rotation speed measured in operation of the internal combustion engine corresponds to twice the value of the measurement rotation speed.

6. The high-pressure injection device of claim 5, wherein the control unit is configured to switch the pressure reduction valve into the transmissive state only on every third engine segment time, and hold the pressure reduction valve open for a time period which is greater than twice the duration of one engine segment time if the rotation speed measured in operation of the internal combustion engine corresponds to three times the value of the measurement rotation speed.

7. The high-pressure injection device of claim 6, wherein the control unit is configured to switch the pressure reduction valve into the transmissive state only on every fourth engine segment time, and hold the pressure reduction valve open for a time period which is greater than three times the duration of one engine segment time if the rotation speed measured in operation of the internal combustion engine corresponds to four times the value of the measurement rotation speed.

8. The high-pressure injection device of claim 1, further comprising:

a high pressure sensor; and a sensor signal provided by the high pressure sensor;

wherein the control unit is configured to determine the operating state of the internal combustion engine taking into account the sensor signal provided by the high pressure sensor.

9. The high-pressure injection device of claim 1, further comprising a fuel tank, wherein the fuel return line is connected to the fuel tank.

10. The high-pressure injection device of claim 1, further comprising a fuel filter, wherein the fuel return line is connected to the fuel filter.

* * * * *